United States Patent [19]

Fleming et al.

[11] 4,364,210

[45] Dec. 21, 1982

[54] FIRE BARRIER DEVICE

[75] Inventors: Peter B. Fleming, Woodbury, Minn.; Richard R. Licht, New Richmond, Wis.; Joseph C. Peisert, St. Paul, Minn.

[73] Assignee: Minnesota Mining and Manufacturing Company, Saint Paul, Minn.

[21] Appl. No.: 154,456

[22] Filed: May 29, 1980

[51] Int. Cl.[3] ..... E04B 5/48

[52] U.S. Cl. ..... 52/221; 52/232; 174/151; 285/187; 285/200

[58] Field of Search ..... 52/220, 221, 232; 285/200, 205, 42, 46; 277/26; 174/151; 285/187, 196

[56] References Cited

U.S. PATENT DOCUMENTS

| | | | |
|---|---|---|---|
| 3,126,089 | 3/1964 | Hügli | 411/517 |
| 3,476,411 | 11/1969 | Herbert | 285/205 |
| 3,864,833 | 2/1975 | McMarlin | 52/221 |
| 3,932,696 | 1/1976 | Fork | 52/232 |
| 3,995,102 | 11/1976 | Kohant | 52/232 |
| 4,061,344 | 12/1977 | Bradley | 52/232 |
| 4,136,707 | 1/1979 | Gaillot | 52/232 |
| 4,221,092 | 9/1980 | Johnson | 52/232 |
| 4,232,493 | 11/1980 | Gray | 52/232 |
| 4,273,879 | 6/1981 | Langer | 521/91 |

FOREIGN PATENT DOCUMENTS

| | | | |
|---|---|---|---|
| 2154841 | 5/1973 | Fed. Rep. of Germany | 52/232 |
| 2536565 | 2/1977 | Fed. Rep. of Germany | 52/232 |
| 2847156 | 5/1980 | Fed. Rep. of Germany | 52/232 |

OTHER PUBLICATIONS

U.S. patent application 891,397 filed Mar. 31, 1978.

*Primary Examiner*—Price C. Faw, Jr.
*Assistant Examiner*—Henry E. Raduazo
*Attorney, Agent, or Firm*—Cruxan Alexander; Donald M. Sell; Jennie G. Boeder

[57] ABSTRACT

Penetrations or passageways through fire resistant walls, floors, partitions and ceilings are frequently necessary to provide for present or future pipes, cables or conduits. A device fixed to the walls of the penetration provides a barrier to prevent the passing of fire, heat, smoke and toxic gases, and water through the penetration under adverse conditions of fire or elevated temperatures. The device includes at least one end cap capable of providing a cold smoke seal. An intumescent material which in the event of excessive heat or fire, foams and expands to substantially fill the penetration, is provided. The device may include a laminated restraining layer to provide assurance that the char formed during the intumescent reaction to fire and heat, is generated so that the penetration cavity is optimally filled.

24 Claims, 7 Drawing Figures

FIRE BARRIER DEVICE

BACKGROUND OF THE INVENTION

The present invention relates to fire barrier apparatus and method for closing off a penetration in a wall, floor, partition or ceiling to the passage of heat, smoke and toxic gases in the event of a fire.

A generally used method for passing electrical cables, conduits and other mechanical services through a barrier such as a fire resistant wall or floor is directly through a penetration or opening in the barrier. When such a penetration is not provided with a sealing means around the cable, etc., it will permit the direct passage of heat, smoke and toxic gases generated by a fire.

Various devices have been developed for sealing penetrations against the passage of heat, smoke and gases. McMartin, U.S. Pat. No. 3,864,883, relates to apparatus for closing a passageway in an under floor access housing and utilizes a shaped block of intumescent material which, in the event of fire, foams and expands to substantially fill the access housing. The shaped block of intumescent material is positioned in the housing and has dimensions less than the internal dimensions of the housing so that an opening remains around the body of intumescent material.

Another type of device exemplified by Bradley et al., U.S. Pat. No. 4,061,344, utilizes layers of intumescent material and elastomeric material sandwiched between metal compression plates. Cables, pipes or conductors are passed through holes bored in the plates, intumescent and elastomeric materials, and are held tightly enough to form a smoke seal by tightening the compression plates. An obvious disadvantage of this device is that it requires the cable, pipe or conductor diameter to match the hole diameter bored in the device components. In addition, the metal screws or bolts used to tighten or compress the plates together act as conductors of heat in a fire.

SUMMARY OF THE INVENTION

The present invention is embodied in a simple and inexpensive fire barrier device and method for providing fire and smoke stoppage in penetrations through walls, floors, partitions and ceilings.

The device comprises a sleeve of intumescent sheet material lining the interior of the penetration and at least one end cap capable of providing a cold smoke seal when positioned at one end of the sleeve. The sleeve of intumescent sheet material is affixed to the wall of the penetration either by adhesive bonding, bonding during vulcanization of the intumescent sheet, or by mechanical locking means, or a combination thereof. The end cap is designed so that it can be easily penetrated by cables, pipes or conduits, and conforms around the penetrating cable, etc. When the device is subjected to elevated temperatures such as in a fire, the intumescent sheet changes physical and chemical form through expansion to seal off the penetration.

In the device of the present invention there is no continuous thermally conductive metal path through the intumescent material since the intumescent sleeve is affixed to the wall of the penetration without the use of metal screws or bolts.

In addition, the present invention provides a fire barrier which is affixed to the walls of the penetration, thus overcoming one of the main obstacles to effective firestopping. Many of the present methods of firestopping involve reliance on a worker to place and replace easily removable loose conventional insulation material in penetrations during construction and after the running of cables, etc. The device of the present invention allows cables, etc., to be placed, removed or replaced without the disruption of the protective intumescent material, thus, avoiding the danger that the intumescent material will be left out of the penetration.

The device can be installed in any floor or wall penetration and can even be constructed to fit square penetrations. The device can be installed and concrete cast around it.

The unique end cap of the device provides a flame, smoke and gas barrier which is easily penetrated by cables to facilitate wiring installation. Additionally cables can be readily removed from the penetration, and if no holes have been cut in the end cap it remains as an effective seal. The end cap can be readily cut to allow for running any special size cables therethrough. Due to the structure of the end cap the device can protect any number and most sizes of cables, pipes, etc., without requiring any special modifications.

In a preferred embodiment the device employs a unique locking mechanism which allows the device to be simply pressed into the penetration. When the locking mechanism is constructed from the preferred intumescent material or other flameproof elastomeric material the device may be removed and replaced into the penetration many times without damage.

DETAILED DESCRIPTION OF THE INVENTION

Referring now more particularly to the drawings, the fire barrier device, in its simplest form, comprises a sleeve 11 of intumescent sheet material and an end cap 15 of intumescent material or another flameproof elastomeric material.

Figure 1:
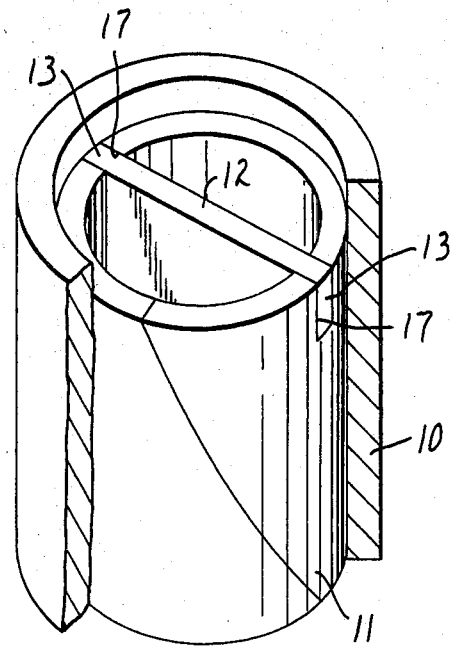
FIG. 1 is a perspective view of one embodiment of a fire barrier device of the present invention with the end cap removed, with parts thereof shown in section.
Figure 3:
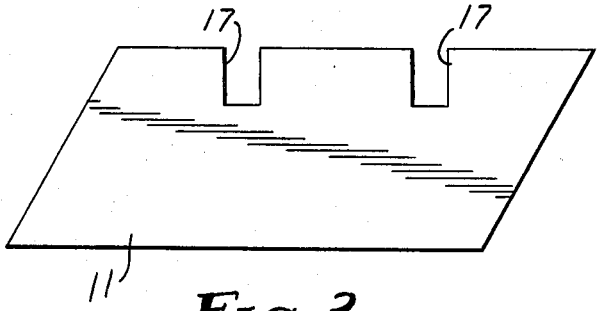
FIG. 3 is an elevational view of the intumescent sheet material prior to being rolled into a cylindrical sleeve as shown in FIG. 1.
Figure 7:
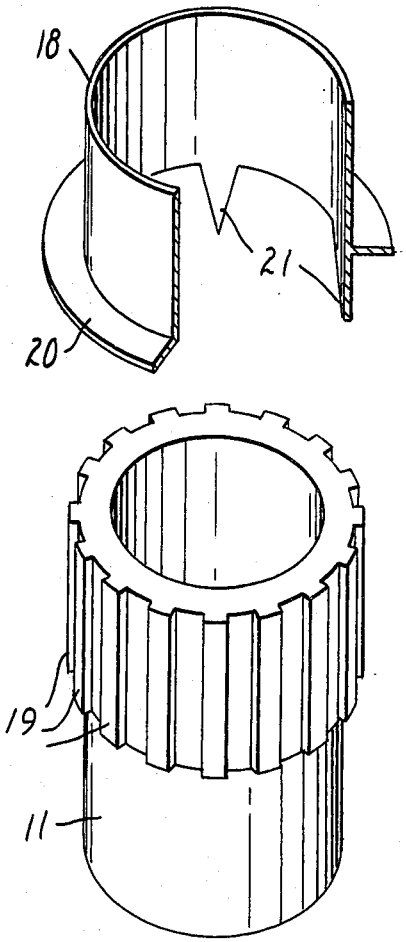
FIG. 7 is an exploded perspective view of the device of FIG. 6.

As clearly shown in FIGS. 1 and 3, sleeve 11 is formed from a flat sheet of intumescent material cut into a parallelogram configuration and helically wrapped to conform to the interior of cylindrical penetration 10. In the case of a square or rectangular penetration, four sheets of rectangular shaped intumescent material would make up sleeve 11. Cutting of the flat sheet stock is easily accomplished with ordinary household scissors and the sheets could be marked to indicate cutting lines for standard sizes. Alternatively, standard die cut sizes could be provided. The sleeve 11 is affixed to the wall of the penetration 10 either by adhesive bonding, heat bonding during vulcanization of the intumescent sheet, or by mechanical locking means or a combination thereof. Suitable adhesive materials for bonding the sleeve 11 to the wall of the penetration 10 are the commonly available contact cements and rubber based adhesives. A mechanical locking means which has been found to be particularly effective for circular penetrations is illustrated in FIG. 7 and comprises a plurality of upstanding ribs 19 formed on one surface of the flat sheet of intumescent material, the ribs 19 being oriented on the outer surface of sleeve 11 when the flat sheet is wrapped into a cylindrical form. The ribs are constructed of the preferred intumescent material or any other rubbery material with a Shore A durometer of about 40–70. When the sleeve is pressed into the penetration, the ribs are slightly deformed and conform to the side wall of the penetration and also tend to fill the void spaces between the ribs thereby holding the sleeve in place by frictional means. The ribs may be vertically or horizontally (circumferential around the device) oriented. In the latter orientation, the ribs provide a superior smoke and gas seal. Other mechanical locking means such as an expanded metal, elastomeric or plastic skirt fitting around the device are suitable and their use is contemplated.

An intumescent material is one which is capable of swelling or expanding under conditions of fire or heat. The preferred intumescent sheet material for sleeve 11 is a flexible, heat expanding, fire retardant composition comprising an intumescent component, such as hydrated alkali metal silicate in granular form, an organic binder component, an organic char-forming component such as a phenolic resin, and fillers. Such a sheet is disclosed in copending commonly assigned application U.S. Ser. No. 52,742 and is commercially available as "Fire Barrier Sheet FS-195" from the 3M Company. These sheets remain in their flexible, unexpanded state but when subjected to temperatures on the order of 110° C. and higher, readily intumesce up to ten times their original volume to form a rigid char and seal the penetration against the passage of fire, heat, smoke, vapors and water. The char that is formed during heat or fire exposure is strong, highly refractory, and is not easily blown out of penetrations when subjected to water hose pressure such as may be present during fire fighting. Of course, other intumescent materials such as Palusol®, commercially available from BASF, and Expantrol®, commercially available from the 3M Co., can be satisfactorily utilized. Preferably also, the intumescent sheet is coated with an elastomeric material such as Neoprene® rubber, to increase the moisture resistance of the intumescent component. Such a rubber coating is provided on the preferred commercially available intumescent sheet material "FS-195".

In a particularly preferred embodiment of the present invention, the expansion direction of the intumescent material is effectively controlled by laminating a restraining layer thereto. Use of a restraining layer can provide assurance that the char formed during the intumescent reaction to fire and heat is generated so that the penetration cavity is optimally filled. The restraining layer is preferably laminated to the surface of the intumescent sheet which face the interior of the penetration. Upon exposure to temperatures greater than about 110° C., the restrained intumescent sheet expands in a direction substantially perpendicular to the restraining layer, i.e., into the penetration, so as to optimally fill it rather than expanding isotropically as would be the case with an unrestrained intumescent sheet. Useful restraining layers are disclosed in commonly assigned copending patent application, Ser. No. 154,455 entitled "Intumescent Fire Barrier Material Laminated With Restraining Layer" filed of even date herewith (attorney's File No. 31,820) incorporated herein by reference, and include metal foils, sheets, and screens made from aluminum, copper, steel, and lead; heavy paper and cardboard such as a Kraft-type paper; high temperature rubber and plastic sheets such as are made from silicones and epoxies; screen and cloth made from inorganic fibers such as fiberglass and high temperature organic fibers such as aramid.

End cap 15 can be fabricated from the same intumescent sheet material comprising sleeve 11 and may be laminated to an elastomeric material, or may be fabricated entirely out of a flameproof elastomeric material. The expansion direction of the end cap may also be controlled by laminating a restraining layer over the intumescent sheet material. As noted earlier, end cap 15 functions mainly to seal the penetration against the passage of flame, smoke and gas, and the use of an elastomeric material improves the seal around the cable, etc., passing through the end cap. In addition, the end cap once locked in place around the cable, etc., acts as a holder therefor.

Figure 5:
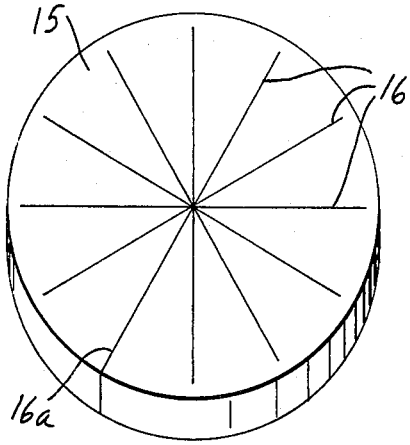
FIG. 5 is a perspective view of the end cap.

A preferred form of end cap 15 is shown in FIG. 5. A plurality of radial cuts 16 are provided in the cap with all but one of the cuts **16*a* terminating within the periphery of the cap such that the cap is divided into a plurality of segments of a circle. It will be appreciated that the segments can be easily displaced to permit the passage of a cable, pipe or conduit past the segment or segments after which the segment or segments can be manipulated into conformance about the cable, etc. It will also be appreciated that slit 16*a*** provides the end cap with the ability to be applied around existing cables, etc. and enables the device of the invention to protect existing cables, pipes and conduits. The ability of the end cap to act as a cold smoke seal can be enhanced by the use of caulk to seal any remaining cracks. Alternatively, the end cap can, of course, be custom fitted with a specific diameter apertures or aperture as desired.

Figure 4:
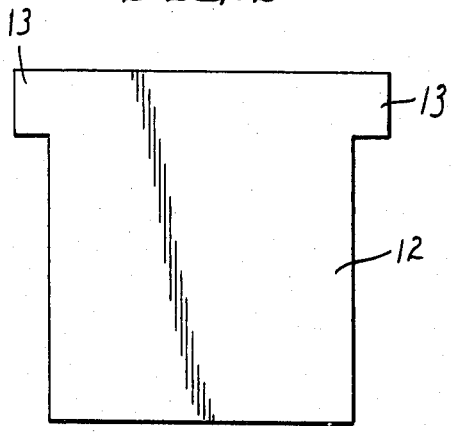
FIG. 4 is an elevational view of a partition.

Although the preferred intumescent material forming sleeve 11 is capable of expanding up to ten times its original volume, we have found it desirable to incorporate an intumescent partition 12 in the device (illustrated in FIGS. 1, 2 and 4) for penetrations having cross-sectional areas greater than about nine square inches in order to assure complete sealing of the penetration in the event of a fire. For larger penetrations, a plurality of partitions 12 could be uniformly spaced within the device.

Figure 2:
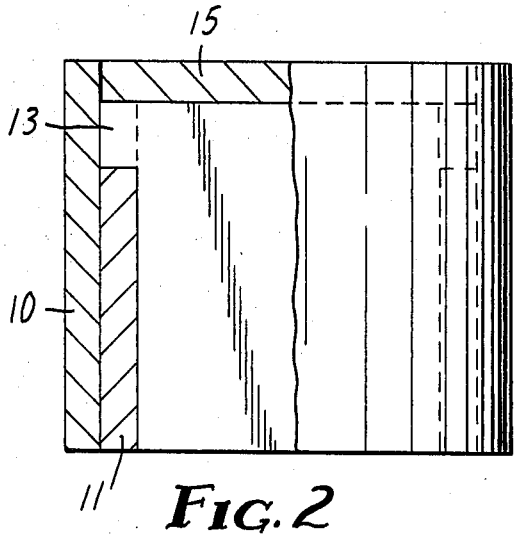
FIG. 2 is an elevational view of the device, with parts thereof shown in section.

Partition 12 is preferably fabricated out of the same intumescent material as sleeve 11 and is generally rectangular in shape with a pair of tabs 13 at one end thereof such that partition 12 is somewhat T-shaped. Tabs 13 are dimensioned to extend outwardly a distance equal to the thickness of sleeve 11 and have a length of preferably about one inch. As shown in FIG. 3, slots 17 in sleeve 11 are provided for the purpose of accomodating tabs 13 as shown in FIG. 2. The dimensions of slots 17 are thus such as to permit tabs 13 to fit therein. Preferably, the intumescent partition 12 has a restraining layer laminated to both sides so that the char generated upon intumescence optimally fills the penetration cavity.

Figure 6:
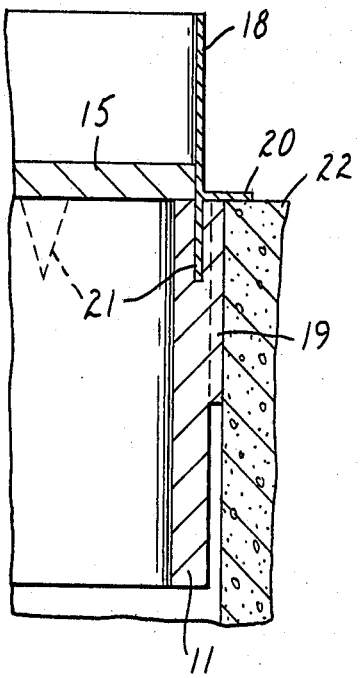
FIG. 6 is a partial sectional view of another embodiment of the fire barrier device of the present invention.

In the embodiment illustrated in FIGS. 6 and 7, a riser/sidewall 18 is incorporated into the device. The riser/sidewall acts as a splash guard to prevent water which may be present during a fire from entering the penetration and shorting out any electrical cables that may be present. The riser/sidewall is locked into sleeve 11 by locking means 21, such as the triangular projections illustrated, which are fabricated from the same material as the riser/sidewall. Such locking means pierce the intumescent material and enable the riser/sidewall to project above and be held around the periphery of the penetration 10. Other locking means such as pins, hooks and barbs of various length can be used with or without adhesives. Riser/sidewall 18 is provided with a flange 20 which acts as a stop against the floor 22 to prevent the riser/sidewall from falling into the penetration. In the embodiment illustrated, end cap 15 is designed to fit within the riser/sidewall 18. The riser/sidewall 18 is usually fabricated out of stainless steel but can be galvanized steel or any other structurally acceptable ferrous or non-ferrous metal or resinous materials such as polyvinyl chloride, polyethylene, nylon or polycarbonate.

When the device illustrated in FIGS. 1–8 is placed in penetrations in a concrete slab and exposed to a controlled furnace fire (temperatures according to the ASTM E-119 standard test conditions) flame passage is totally stopped for up to four hours. The intumescent sheet material upon exposure to fire expands to fill the penetration in the device while forming a strong insulating refractory char. The char expands tightly around any cables, etc. running through the penetration, and can replace any burned away insulation that may be present on the cables, etc. thus preventing flame passage.

The folowing examples illustrate the construction and properties of devices prepared according to the teachings of the present invention.

EXAMPLE 1

Two devices for firestopping a floor penetration were made by forming sheets of intumescent material into 102 mm long cylinders and friction fitting each cylinder into a 102 mm diameter hole in a 914 mm×914 mm square of 102 mm thick concrete. The intumescent material comprised about 25 percent by weight polychloroprene commercially available as Neoprene® W from DuPont, about 56 percent by weight hydrous sodium polysilicate commercially available as "Britesil H24" from Philadelphia Quartz Co., about 11 percent by weight phenolformaldehyde commercially available as "Varcum 5485" from Reichhold Chem. Co., and about 8 percent by weight silica commercially available as "Min-U-Sil" from Pennsylvania Sand and Glass Co., which had been compounded in a Banbury mixer, milled together to a flexible rubbery composition, and sheeted out. The intumescent sheet material of Device I was a 6.35 mm thick layer of intumescent material surface coated on both sides with a 0.127 mm layer of nonrestraining Neoprene® rubber. The intumescent sheet material of Device 2 was a 6.35 mm layer of intumescent material surface coated on the surface facing the interior of the penetration with a restraining layer comprising a 0.064 mm layer of aluminum foil and coated on the opposite side with a 0.127 mm layer of Neoprene® rubber. Each device had an end cap; Device 1 had an end cap made of the same intumescent sheet material which lined the hole and Device 2 had an end cap made of the same intumescent material surface coated on both sides with a 0.064 mm layer of aluminum foil.

The assemblies were subjected to an ASTM E-119 time-temperature exposure in a gas fired furnace. After firing for 60 minutes, the aluminum foil coated intumescent sheet expanded to completely close the penetration; heat leaks existed in the device utilizing "FS-195" with no restraining layer. There was no flame breakthrough after 60 minutes of fire exposure with either device thus illustrating that both types of devices provide firestopping.

EXAMPLE 2

A fire barrier device constructed from the same intumescent sheet material as Device 2 in Example 1, was wrapped into a cylinder such that the aluminum coating faced the interior of the cylinder. The cylinder was friction fit into a 152 mm pipe that had been set in a 127 mm thick concrete slab. Two intumescent partitions were inserted into the cylinder so as to form four areas of equal dimensions. The intumescent partitions were made of the intumescent material of Example 1 coated on both sides with 0.064 mm inch aluminum foil. An end cap 152 mm in diameter and 6.35 mm in thickness, comprising the intumescent material of Example 1 and coated on both sides with 0.064 mm aluminum foil, was placed on top the cylinder. The device was fire tested using an ASTM E-119 time-temperature cycle. Thermocouples were placed on and around the device to measure the temperature rise. The results and observations are recorded in Table I. Thermocouple A measured the furnace temperature; B measured the temperature 6.35 mm from the outer edge of the pipe on the top sides of the concrete; and C measured the temperature on top of the end cap. The device allowed the temperature on top of the end cap to remain relatively cool. The device prevented the passage of flames throughout the entire test.

TABLE I

| Time (in min.) | Temperature (in °C.) A | B | C | Observation at top of device |
|---|---|---|---|---|
| 0 | 38 | 17 | 17 | No smoke or flame |
| 1 | 311 | 17 | 21 | No smoke or flame |
| 2 | 409 | 17 | 33 | Small amount of smoke |
| 5 | 542 | 20 | 56 | Amount of smoke increasing |
| 10 | 654 | 28 | 77 | End cap lifting |
| 20 | 760 | 45 | 79 | Opening sealed off |
| 30 | 830 | 77 | 81 | No smoke or flame |
| 60 | 950 | 118 | 85 | No smoke or flame |
| 90 | 1014 | 186 | 91 | No smoke or flame |
| 120 | 1049 | 263 | 111 | No smoke or flame |

EXAMPLE 3

A fire barrier device was constructed by friction fitting 4 rectangular pieces of the 6.35 mm intumescent sheet material of Example 1, heat bonded on one side to a restraining layer comprising a first layer of 1.14 mm steel sheeting and an additional coating of 0.064 mm aluminum foil and coated on the other side with 0.127 mm Neoprene® rubber, into a 152×152 mm rectangular opening in a 127 mm thick concrete slab. The rectangular pieces were fit into the opening with the aluminum facing the interior of the penetration. Intumescent partitions were fabricated from the 6.35 mm thick intumescent material of Example 1, laminated on both sides with a restraining layer of 0.064 mm aluminum. Slots were provided in the rectangular pieces and the partitions were inserted into the opening in criss cross fashion so as to divide the opening into four rectangular areas of equal dimensions. An end cap made from the 6.35 mm thick intumescent material of Example 1 coated on both sides with 0.064 mm aluminum foil was placed on top the opening. The device was fire tested using an ASTM E-119 time-temperature cycle for a period of two hours. The opening was completely sealed by the intumescent material within 30 minutes. No flame passage was noted throughout the test.

EXAMPLE 4

Two fire barrier devices were constructed, one having an end cap and the other lacking an end cap to illustrate the superior results achieved with a device having an end cap such as is disclosed in the instant application.

The fire barrier device lacking an end cap was constructed from the same intumescent sheet material as Device 2 in Example 1, wrapped into a cylinder and friction fitted it into a 76.2 mm long, 76.2 mm diameter plastic cylinder such that the aluminum coating faced the interior of the cylinder. The cylinder was friction fit into a 76.2 mm hole bored into a 127 mm thick concrete slab. Temperature measuring thermocouples were placed on and around the device to measure temperature rise. The device was tested using ASTM E-119 time temperature cycle. The results and observations are recorded in Table II. Thermocouple A measured the furnace temperature and B measured the temperature directly above the opening at the concrete level. Within 15 minutes the opening was completely closed and the temperature on the top had been reduced by 90 percent.

TABLE II

| Time (in mins.) | Temperature (in °C.) A | B | Observations at Top of Device |
|---|---|---|---|
| 1 | 454 | 16 | Flame passage |
| 3 | 516 | 504 | 50% seal |
| 5 | 560 | 493 | 60% seal |
| 9 | 638 | 104 | 95% seal |
| 15 | 704 | 32 | 100% seal |
| 20 | 738 | 38 | 100% seal |
| 30 | 871 | 43 | 100% seal |
| 45 | 949 | 60 | 100% seal |
| 60 | 960 | 102 | 100% seal |

A fire barrier device similar to the device above but having an end cap was constructed by wrapping the intumescent sheet material into a cylinder and friction fitting it into a 76.2 mm long, 102 mm diameter metal cylinder such that the aluminum coating faced the interior of the cylinder. The cylinder was friction fit into a 76.2 mm hole bored into a 127 mm thick concrete slab. An end cap 76.2 mm in diameter and comprising intumescent sheet material coated on both sides with 0.064 mm thick aluminum foil was placed on top of the cylinder. The device was tested using ASTM E-119 time temperature cycle. The results and observations are recorded in Table III. Thermocouple A measured the furnace temperature and B measured the temperature on top the end cap. Within three minutes the opening was completely closed.

TABLE III

| Time (in mins.) | Temperature (in °C.) A | B | Observations at Top of Device |
|---|---|---|---|
| 1 | 454 | 32 | No flame passage |
| 3 | 677 | 32 | 100% seal |
| 5 | 727 | 38 | 100% seal |
| 10 | 799 | 43 | 100% seal |
| 15 | 838 | 49 | 100% seal |
| 20 | 871 | 52 | 100% seal |
| 30 | 899 | 54 | 100% seal |

A comparison of Table II with Table III indicates that a device utilizing an end cap seals openings subjected to fire in a shorter period of time, and that the temperature on top of the device remains relatively low throughout the fire.

What is claimed is:

1. A fire barrier device for providing fire and smoke stoppage in penetrations through walls, floors, partitions and ceilings comprising:

(a) a sleeve of intumescent sheet material lining the interior of said penetration and affixed to the wall of said penetration, said sleeve occupying only a minor portion of said penetration, and said intumescent sheet material operable to expand when said penetration is subjected to elevated temperatures and substantially fill said lined penetration; and (b) at least one end cap positioned at one end of said sleeve, said end cap capable of being penetrated by pipes or cables passing through said lined penetration and conforming around said pipes or cables, and said end cap capable of sealing said penetration against the passage of flames, smoke and gases through said penetration from one end to the other;

said fire barrier device being capable of allowing any number and most sizes of pipes or cables to be placed, removed, or replaced without disruption of said intumescent sleeve material, and said fire barrier device providing a wide clearance between said pipes or cables and said intumescent sleeve.

2. The device of claim 1 wherein said intumescent sheet material comprises an alkali metal silicate as the intumescent component.

3. The device of claim 1 wherein said intumescent sheet material comprises an intumescent component in granular form, an organic binder component, an organic char-forming component and fillers and wherein said sheet material is coated with an elastomeric layer.

4. The device of claim 1 wherein said intumescent sheet material comprises an intumescent component in granular form, an organic binder component, an organic char-forming component and fillers; and wherein the surface of said sheet facing the interior of said penetration has a restraining layer laminated thereto.

5. The device of claim 1 wherein said end cap has a plurality of radial cuts, all but one of said cuts terminating within the periphery of said cap such that said cap is divided into a plurality of segments, each of said segments being juxtaposed to another segment to provide said cap with no voids therein, said segments capable of being displaced to permit the passage of a cable or pipe past said segments and said segments being capable of being manipulated into conformance about said cable or pipe.

6. The device of claim 1 wherein said end cap contains at least one aperture to permit passage of at least one cable or pipe therethrough wherein said aperture has a cross sectional area equal to the cross sectional area of said cable or pipe.

7. The device of claim 1 wherein said end cap is fabricated from an intumescent sheet material comprising an alkali metal silicate intumescent component.

8. The device of claim 7 wherein said intumescent sheet material is coated with an elastomeric material on at least one major surface.

9. The device of claim 7 wherein said intumescent sheet material has a restraining layer laminated to at least one major surface thereof.

10. The device of claim 1 wherein said end cap is fabricated from a flameproof elastomeric material.

11. The device of claim 1 wherein said intumescent sheet material is affixed to said wall of said penetration by adhesive bonding.

12. The device of claim 3 wherein said intumescent sheet material is affixed to said wall of said penetration by heat bonding during vulcanization of said intumescent sheet.

13. The device of claim 1 wherein said intumescent sheet material is affixed to said wall of said penetration by mechanical locking means.

14. The device of claim 1 containing at least one intumescent partition placed within said intumescent sleeve to divide said penetration into substantially equal areas.

15. The device of claim 14 wherein said intumescent partition comprises an alkali metal silicate and wherein said intumescent partition has a restraining layer laminated to both major surfaces.

16. The device of claims 4, 9, or 16 wherein said restraining layer comprises a material selected from the group consisting of metal, heavy paper, cardboard, high temperature rubber, high temperature plastic, and inorganic fibers.

17. A method of providing a fire and smoke barrier for penetrations in walls, floors, partitions and ceilings comprising the steps of:

(a) positioning a sleeve of intumescent material in the interior of a conduit to line said conduit, by affixing said sleeve to the interior wall of said conduit;

(b) positioning said conduit in the interior of said penetration to line said penetration and affixing said conduit to the wall of said penetration; and (c) positioning an end cap at at least one end of said sleeve to seal said penetration against the passage of flames, smoke and gas, said end cap being capable of being penetrated by pipes or cables passing through said sleeve and conforming around said pipes or cables.

18. The method of claim 17 wherein said intumescent sheet material comprises an intumescent component in granular form, an organic binder component, an organic char-forming component and fillers and wherein said sheet material is coated with an elastomeric layer; and wherein said method includes the step of affixing said sleeve to said interior wall of said conduit by heat bonding during vulcanization of said intumescent sheet.

19. A fire barrier device for providing fire and smoke stoppage in penetrations through walls, floors, partitions and ceilings comprising:

(a) a sleeve of intumescent sheet material lining the interior of said penetration and affixed to the wall of said penetration, said intumescent sheet material operable to expand when said penetration is subjected to elevated temperatures and substantially fill said lined penetration; said intumescent sheet material being affixed to said wall of said penetration by mechanical locking means comprising ribs oriented on the outer surface of said sleeve such that when said sleeve is pressed into said penetration said ribs deform and conform to said wall of said penetration to hold said sleeve in place in said penetration by the force of friction, said ribs being constructed from a rubbery material having a Shore A durometer of about 40–70; and (b) at least one end cap positioned at one end of said sleeve, said end cap capable of being penetrated by pipes or cables passing through said lined penetration and conforming around said pipes or cables and said end cap capable of sealing said penetration against the passage of flames, smoke and gases through said penetration from one end to the other.

20. A fire barrier device for providing fire and smoke stoppage in penetrations through walls, floors, partitions and ceilings comprising:

(a) a sleeve of intumescent sheet material lining the interior of said penetration and affixed to the wall of said penetration, and at least one intumescent partition placed within said lined penetration to divide said penetration into substantially equal areas, said intumescent partition being rectangular in shape and having one pair of tabs at one end thereof such that said partition is T-shaped, said tabs extending outwardly a distance equal to the thickness of said sleeve, and wherein said sleeve is provided with at least one pair of slots at one end thereof such that said tabs of said partition fit therein; said intumescent material operable to expand when said penetration is subjected to elevated temperatures and substantially fill said lined penetration; and (b) at least one end cap positioned at one end of said sleeve, said end cap capable of being penetrated by pipes or cables passing through said lined penetration and conforming around said pipes or cables and said end cap capable of sealing said penetration against the passage of flames, smoke and gases through said penetration from one end to the other.

21. A fire barrier device for providing fire and smoke stoppage in penetrations through walls, floors, partitions and ceilings comprising:

(a) a sleeve of intumescent sheet material lining the interior of said penetration and affixed to the wall of said penetration, said intumescent material operable to expand when said penetration is subjected to elevated temperatures and substantially fill said lined penetration;

(b) at least one end cap positioned at one end of said sleeve, said end cap capable of being penetrated by pipes or cables passing through said lined penetration and conforming around said pipes or cables and said end cap capable of sealing said penetration against the passage of flames, smoke and gases through said penetration from one end to the other; and (c) a riser/sidewall attached at one end of said sleeve so as to project from and be held around the periphery of said penetration, said riser/sidewall serving as a splash guard to prevent water from entering said penetration.

22. A method of providing a fire and smoke barrier for penetrations in walls, floors, partitions and ceilings comprising the steps of:

(a) positioning a sleeve of intumescent sheet material in the interior of said penetration to line said penetration, said sleeve occupying only a minor portion of said penetration, and said intumescent material operable to expand when said penetration is subjected to elevated temperatures and substantially fill said lined penetration;

(b) affixing said sleeve to the wall of said penetration; and (c) positioning an end cap at at least one end of said sleeve to seal said penetration against the passage of flames, smoke and gas, said end cap being capable of being penetrated by pipes or cables passing through said lined penetration and conforming around said pipes or cables;

said sleeve and said end cap being capable of allowing any number and most sizes of pipes or cables to be placed, removed, or replaced without disruption of said intumescent sleeve material, and said fire barrier device providing a wide clearance between said pipes or cables and said intumescent sleeve.

23. The method of claim 22 wherein said method includes the step of affixing said sleeve to said interior wall of said penetration by adhesive bonding.

24. The method of claim 22 wherein said method includes the step of affixing said sleeve to said interior wall of said penetration by mechanical locking means.

* * * * *